US006478646B1

(12) United States Patent
Fukuoka et al.

(10) Patent No.: US 6,478,646 B1
(45) Date of Patent: Nov. 12, 2002

(54) DRIVE DEVICE OF INBOARD AND OUTBOARD ENGINES

(75) Inventors: Teruhito Fukuoka; Yuji Hashimoto; Kazuyoshi Shinada, all of Osaka (JP)

(73) Assignee: Yanmar Diesel Engine Co., Ltd. (JP)

( * ) Notice: Subject to any disclaimer, the term of this patent is extended or adjusted under 35 U.S.C. 154(b) by 0 days.

(21) Appl. No.: 09/647,999

(22) PCT Filed: Mar. 26, 1999

(86) PCT No.: PCT/JP99/01594

§ 371 (c)(1),
(2), (4) Date: Nov. 21, 2000

(87) PCT Pub. No.: WO99/52767

PCT Pub. Date: Oct. 21, 1999

(30) Foreign Application Priority Data

Apr. 10, 1998 (JP) ..... 10-099150

(51) Int. Cl.[7] ..... B63H 23/36; B63H 21/10
(52) U.S. Cl. ..... 440/112; 440/88
(58) Field of Search ..... 440/53, 57, 64, 440/75, 83, 88, 111, 112

(56) References Cited

U.S. PATENT DOCUMENTS 3,452,704 A * 7/1969 Watkins ..... 440/57
3,750,616 A * 8/1973 Nelson ..... 440/63
4,236,478 A * 12/1980 Mansson ..... 440/112
4,464,128 A * 8/1984 Aso et al. ..... 440/112
4,501,560 A * 2/1985 Brandt et al. ..... 440/53
4,904,214 A * 2/1990 Eick ..... 440/83
4,911,666 A * 3/1990 Gage et al. ..... 440/89
4,938,723 A * 7/1990 Yoshimura et al. ..... 440/52
5,735,718 A * 4/1998 Ekwall ..... 440/83

FOREIGN PATENT DOCUMENTS

| | | |
|---|---|---|
| JP | 62-21518 | 6/1987 |
| JP | 1-34837 | 7/1989 |
| JP | 1-120493 | 8/1989 |

* cited by examiner

*Primary Examiner*—S. Joseph Morano
*Assistant Examiner*—Andrew Wright
(74) *Attorney, Agent, or Firm*—Sterne, Kessler, Goldstein & Fox P.L.L.C.

(57) ABSTRACT

A drive of inboard-and-outboard engines, wherein a drive gear unit (10) meshing with driven gears (25, 26) disposed on the upper end side of a drive shaft (28) disposed generally in vertical direction is formed slidably in a direction perpendicular to the drive shaft (28), whereby the drive gear unit (10) can be operated slidably from the outside of an upper unit (9) located at the top of an outer drive unit (5) disposed inside a hull (1).

2 Claims, 10 Drawing Sheets

DRIVE DEVICE OF INBOARD AND OUTBOARD ENGINES

FIELD OF THE ART

The present invention relates to a drive device of an inboard-and-out-board propulsion machine to be mounted onto a boat like a yacht, especially improved in its maintenance efficiency.

BACKGROUND ART

Conventionally, there is a well-known inboard-and-outboard propulsion machine for a boat like a yacht, such that a drive unit connected to an engine is disposed through an opening of a hull of the boat so as to make a lower unit of the drive unit project in water, and the drive unit is provided therein with a substantially vertical drive shaft, as disclosed in Japanese Patent Hei.1-34837, for example.

The inboard-and-outboard propulsion machine comprises an upper unit disposed in the hull to be connected to the engine. In the upper unit is disposed a drive gear unit for transmitting power of the engine to the drive shaft through a clutch.

The propulsion machine is usually installed in the state that the engine is disposed in front of the drive unit. However, it is so constructed that the upper unit can be rotated at a 180° in relation to the lower unit for enabling the engine to be disposed behind the drive unit in correspondence to the structure of the hull and so on, as disclosed in Japanese Utility Model Sho.62-21518, for example.

At the lower end of the drive unit projecting outwardly from the hull is provided an oil-drain outlet from which old lubricating oil circulated in the drive unit is drained out so as to be exchanged for new lubricating oil.

However, the drive unit must be separated from the engine because the drive gear unit for its maintenance, because the drive gear unit, the clutch and the like are assembled together in the drive unit of the conventional propulsion machine. Therefore, the maintenance of the drive unit is complicated and it is difficult to be performed on the sea.

Furthermore, the exchange of lubricating oil in the drive unit is complicated because it requires the hull to be lifted so as to drain the lubricating oil from the oil-draining opening provided at the lower end of the drive unit.

Some ports or harbors are equipped with no lifting device for a boat like a yacht, where the exchange of lubricating oil is impossible.

DISCLOSURE OF THE INVENTION

For being applied to an inboard-and-outboard propulsion machine including a drive unit mounted through an opening of a hull and brought into connection with an engine so that a lower unit serving as a lower part of the drive unit projects from the opening into water and a drive shaft is substantially vertically disposed in the drive unit, according to the present invention, a drive gear unit meshing with a follower gear disposed on an upper portion of the drive shaft is slidable in perpendicular to the drive shaft, and the drive gear unit is operable for its sliding movement from the outside of an upper unit serving as an upper part of the drive unit disposed in the hull. Therefore, a clutch shaft and the like can be removed from the upper unit disposed in the hull for maintenance of the interior of the upper unit while the engine and the drive unit are connected with each other. In other words, while the engine and the drive unit are left on the hull, the maintenance can be performed easily even on the sea.

Also, for an inboard-and-outboard propulsion machine which is similar with the same-mentioned, according to the present invention, an oil-circulation passage for circulating lubricating oil in the drive unit and an oil-drain passage for draining lubricating oil outward from the drive unit communicate with each other, and an oil-drain outlet of the oil-drain passage is provided at an upper unit serving as an upper part of the drive unit disposed in the hull. Therefore, the lubricating oil to the very bottom drop in the drive unit can be drained out from the oil-drain outlet, thereby enhancing the efficiency of its maintenance. Also, the lubricating oil in the drive unit can be exchanged on the sea without lifting the boat at a port or a harbor.

Also, for a inboard-and-outboard propulsion machine which is similar with the same-mentioned, according to the present invention, an upper unit serving as an upper part of said drive unit disposed in said hull can be rotated for its mounting at an approximate 180° phase with respect to said lower unit, an oil-circulation passage for circulating lubricating oil in said drive unit and an oil-drain passage for draining lubricating oil outward from said drive unit communicate with each other, an oil-drain outlet of said oil-drain passage is provided at said upper unit disposed in said hull, a communication passage is disposed at a joint portion between said upper unit and said lower unit so that an upper oil-circulation passage and an upper oil-drain passage of said upper unit are respectively brought into communication with a lower oil-circulation passage and a lower oil-drain passage through said communication passage, said communication passage includes a pair of mounting portions apart from each other at an approximate 180° phase, and a passage shutter for dividing said communication passage into two parts is selectively mounted to one of said pair of mounting portions, thereby ensuring the communication between said upper and lower oil-circulation passages and the communication between said upper and lower oil-drain passages in whichever direction said upper unit is mounted. Therefore, whichever the upper unit is directed, lubricating oil can be circulated through the same passages in the drive unit, and drained from the same oil-drain outlet, thereby enhancing the efficiency of maintenance of the drive unit so that the lubricating oil can be exchanged on the sea.

BEST MODE FOR CARRYING OUT THE INVENTION

An embodiment of the present invention will be described in accordance with accompanying drawings.

Figure 1:
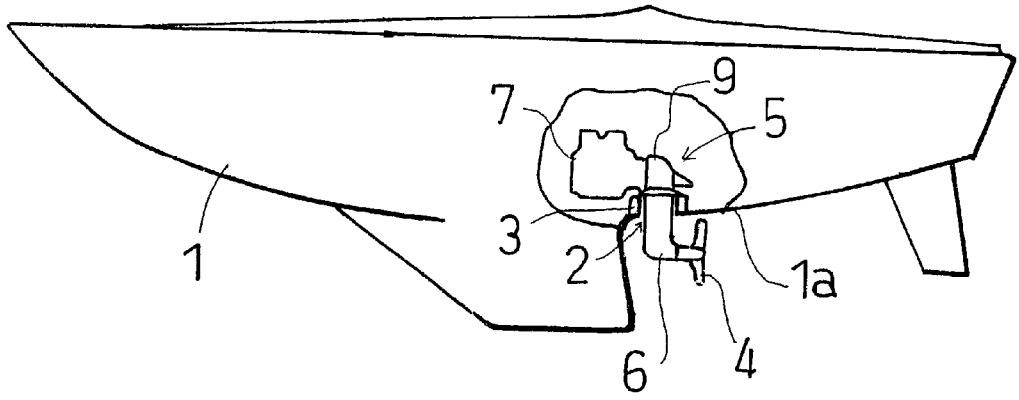
FIG. 1 is a side view of an entire boat equipped with an inboard-and-outboard propulsion machine according to the present invention.

Firstly, description will be given on a general construction of a boat installed with an inboard-and-outboard propulsion machine according to the present invention. As shown in FIG. 1, the propulsion machine comprises an engine 7 fixed in a hull 1; and a drive unit 5 serving as a drive device connected to the rear end of engine 7. Drive unit 5 is mounted to an annular mount base 3 attached onto a bottom-of-hull 1*a*.

Drive unit 5 comprises an upper unit 9 and a lower unit 6. Upper unit 9 is disposed in hull 1 so as to be connected to engine 7. Lower unit 6 projects into water from an opening 2 at bottom-of-hull 1*a*. A propeller 4 is rotatably provided onto the lower end of lower unit 6.

Figure 2:
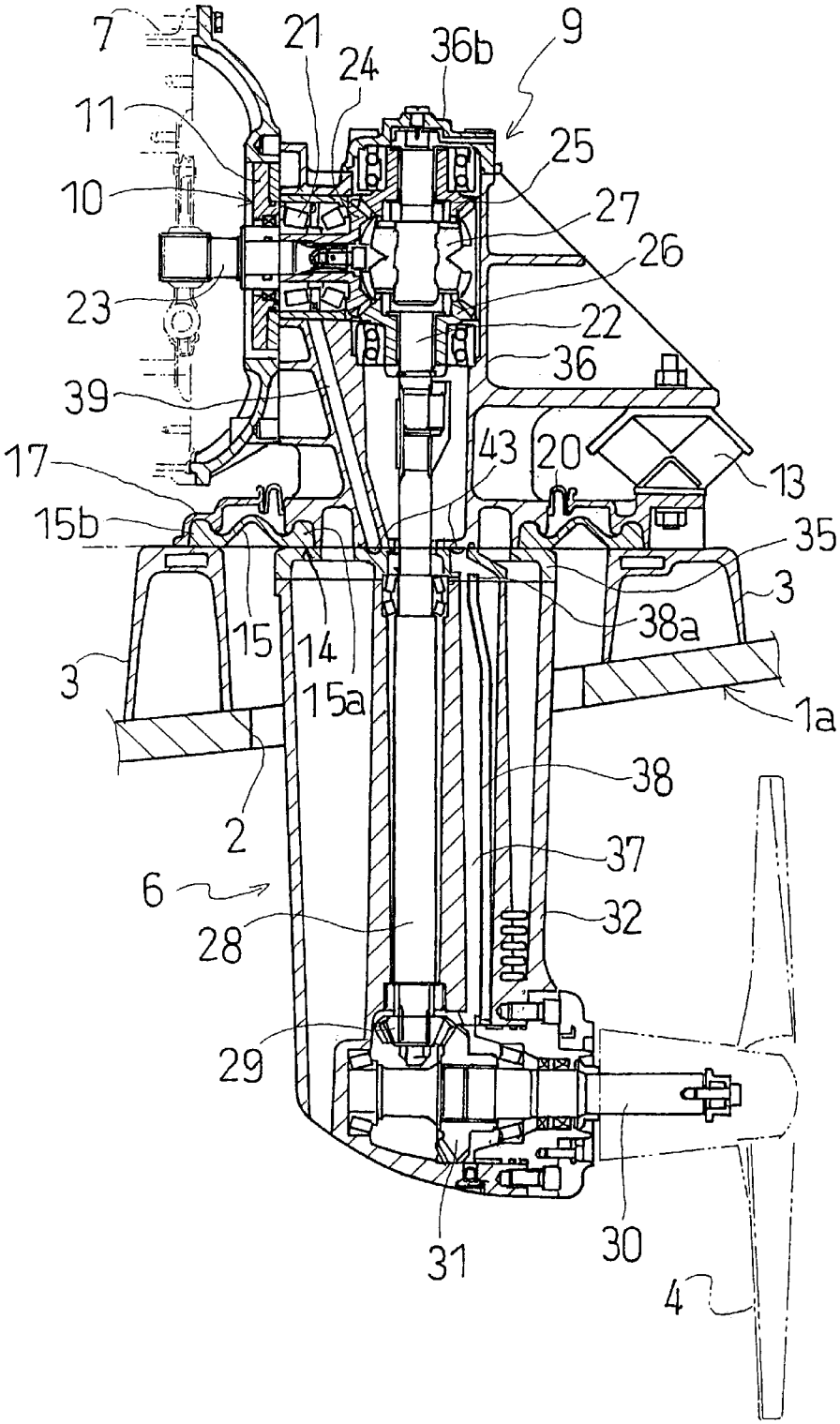
FIG. 2 is a sectional side view of a drive unit.

Description will now be given on drive unit 5. As shown in FIG. 2, upper unit 9 and lower unit 5 are jointed together through a joint surface 14 by use of a plurality of bolts, for example.

Drive unit 5 is provided at its portion to be mounted to mount base 3 with an annular first seal 15 made of diaphragm. An inner peripheral thick portion 15*a* of first seal 15 is fixedly sandwiched between upper unit 9 and lower unit 6 on joint surface 14. An outer peripheral thick portion 15*b* is fixedly sandwiched between mount base 3 and an annular seal flange 17.

Above first seal 15, a second seal 20 is interposed between annular seal flange 17 and an upper casing 36 of upper unit 9.

Drive unit 5 is fixedly mounted through a rubber isolator 13 to annular seal flange 17 screwed to mount base 3.

Upper unit 9 comprises a horizontally longitudinal drive shaft 23. A front end of drive shaft 23 projects outward from upper casing 36 into connection with engine 7. A drive gear 24 is fixed onto the rear end of drive shaft 23. Drive shaft 23 is rotatably supported by a housing 11 through a drive shaft bearing 21. Housing 11 is longitudinally slid ably attached to upper casing 36.

Drive gear 24, drive shaft 23, drive shaft bearing 21 and housing 11 are assembled together, thereby serving as a drive gear unit 10.

A clutch shaft 22 is substantially vertically disposed in upper unit 9. Follower gears 25 and 26 are rotatably provided on clutch shaft 22 so as to mesh with drive gear 24. A clutch 27 is splined with clutch shaft 22 between follower gears 25 and 26 so as to selectively mesh with either follower gear 25 or 26.

Lower unit 6 comprises a substantially vertical drive shaft 28, which is rotatably supported by a lower casing 32. An upper end of drive shaft 28 projects upwardly from lower casing 32 into detachable connection with a lower end of clutch shaft 22. A bevel gear 29 is fixed onto a lower end of drive shaft 28.

Lower unit 6 is provided at its lower end portion with a longitudinal propeller shaft 30 rotatably supported by lower casing 32.

A bevel gear 31 is fixed onto a front end of propeller shaft 30 so as to mesh with bevel gear 29. A propeller 4 is fixed onto a rear end of propeller shaft 30 projecting backwardly from lower casing 32.

Figure 3:
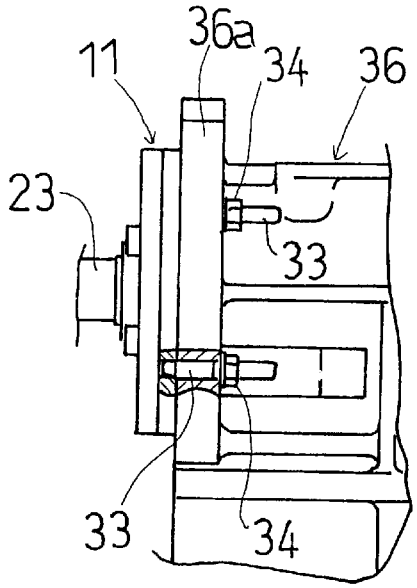
FIG. 3 is a side view of a housing of an upper unit and an upper casing wherein the housing of the upper unit is fixed to the upper casing.
Figure 4:
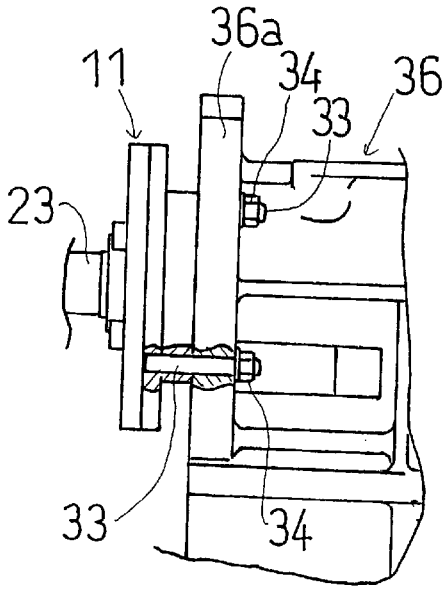
FIG. 4 is a side view of the same wherein the housing of the upper unit has been slid toward an engine.

As shown in FIG. 3, a plurality of bolts 33 mounted on housing 11 of drive gear unit 10 penetrate a flange 36*a* of upper casing 36.

Nuts 34 are respectively screwed on bolts 33 so as to join upper casing 36 and housing 11.

Figure 5:
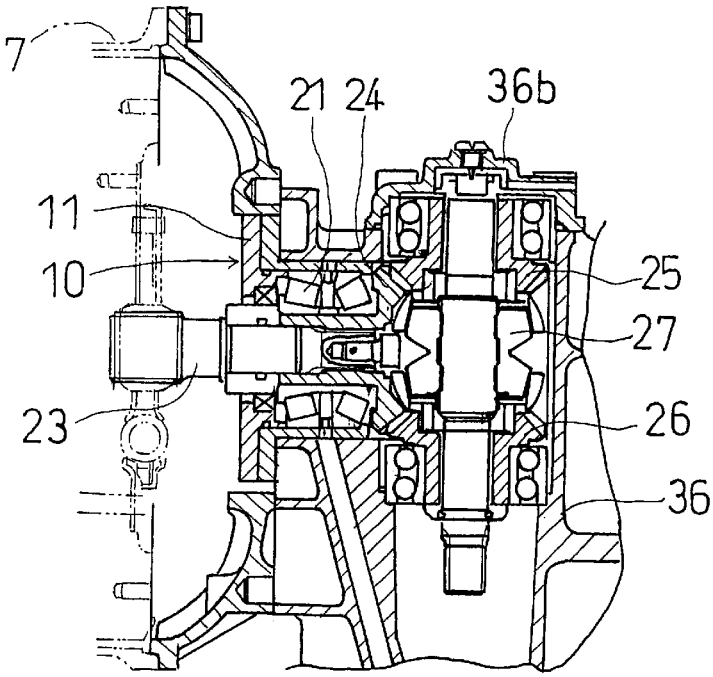
FIG. 5 is a sectional side view of the same wherein the housing of the upper unit is fixed to the upper casing.
Figure 6:
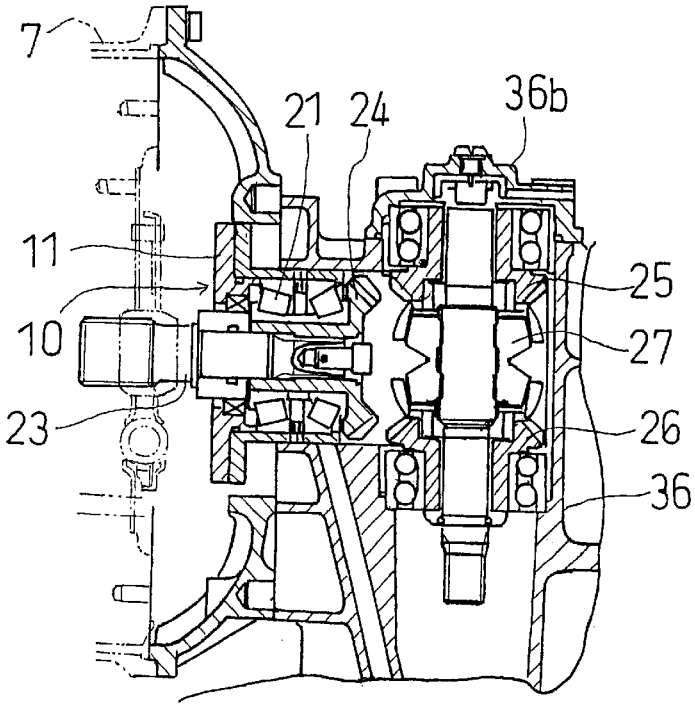
FIG. 6 is a sectional side view of the same wherein the housing of the upper unit has been slid toward the engine.

In this state, drive gear unit 10 is positionally fixed relative to upper casing 36. As shown in FIG. 5, drive gear 24 meshes with both follower gears 25 and 26.

In the state as shown in FIG. 3, if nuts 34 for joining upper casing 36 and housing 11 are loosened, drive gear unit 10 becomes operable from the outside of upper unit 9 for its sliding movement forward from upper casing 36.

In the resultant state, drive gear 24 has been shifted forwardly apart from follower gears 25 and 26. If a lid 36*b* of upper casing 36 is removed, clutch shaft 22 together with follower gears 25 and 26 and clutch 27 can be pulled out upwardly from upper casing 36.

Due to the constructions such as to enable drive gear unit 10 to slide forward from upper casing 36 and such as to enable clutch shaft 22 et al. to be upwardly pulled out, maintenance of the interiors of upper unit 9 and lower unit 6 can be performed by removal of clutch shaft 22 et al. from upper unit 9. Therefore, while engine 7 and drive unit 5 are left in the hull, it is impossible to perform the maintenance easily even on the sea.

As shown in FIG. 2, for the purpose of circulation of lubricating oil in drive unit 5, a lower oil-circulation passage 37 is formed in lower unit 6, and an upper oil-circulation passage 39 in upper unit 9.

Figure 7:
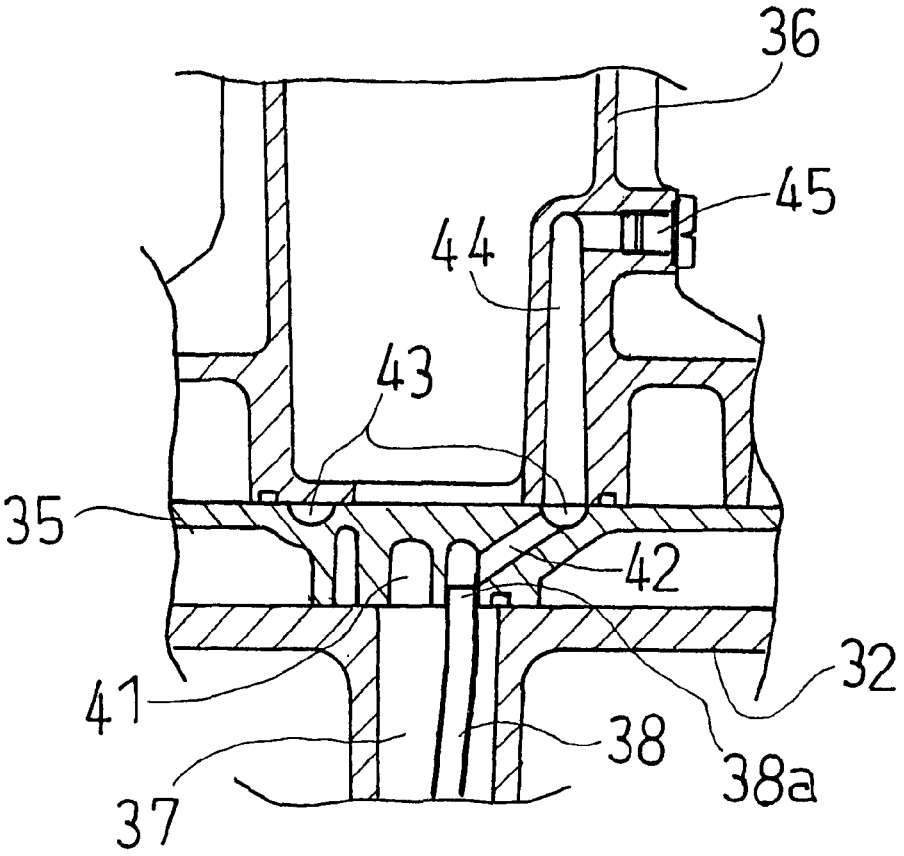
FIG. 7 is a sectional side view of a joint portion between the upper unit and a lower unit.

For draining the lubricating oil outward from drive unit 5, in lower unit 6 is disposed an oil-drain pipe 38 serving as a lower oil-drain passage into connection with lower oil-circulation passage 37 in the lower end portion of lower unit 6. As shown in FIG. 7, an upper oil-drain passage 44 is formed in upper unit 9. Upper oil-drain passage 44 communicates with outside through an oil-drain outlet 45 formed in upper unit.

On the top of lower unit 6, that is, between lower unit 6 and upper unit 9 is disposed a communication passage member 35, through which lower and upper oil-circulation passages 37 and 39 communicate with each other, and oil-drain pipe 38 and upper oil-drain passage 44 communicate with each other.

In this regard, an upper end of lower oil-circulation passage 37 communicates with a communication passage 43 as a groove formed into the upper surface of communication passage member 35 through a guide passage 41 for circulated oil. Communication passage 43 further communicates with upper oil-circulation passage 39.

Also, a top opening 38*a* of oil-drain pipe 38 communicates with communication passage 43 through a guide passage 42 for drained oil formed in communication passage member 35. Communication passage 43 further communicates with upper oil-drain passage 44.

Thus, lower oil-circulation passage 37 and upper oil-circulation passage 39 communicate with each other through a communication passage 43 formed in communication passage member 35, thereby circulating lubricating oil in the whole of drive unit 5. Also, oil-drain pipe 38 and upper oil-drain passage 44 communicate with each other through communication passage 43, thereby draining lubricating oil to the very bottom drop in drive unit 5 from oil-drain outlet 45 formed in upper unit 9.

Due to this construction, lubricating oil in drive unit 5 can be exchanged on the sea even if the boat is lifted at a port or a harbor, thereby enhancing the maintenance efficiency of the boat.

Figure 8:
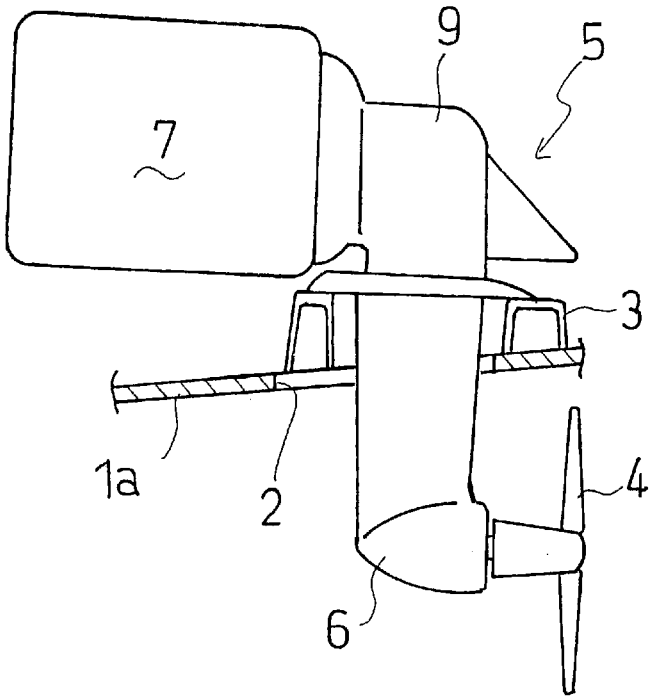
FIG. 8 is a side view of the propulsion machine wherein the upper unit is disposed so as to arrange the engine in front of the drive unit.

The present propulsion machine usually installed onto a boat like a yacht so as to arrange engine 7 in front of drive unit 5, as shown in FIG. 8.

However, when a boat to which the propulsion machine is applied is used for some kinds of purposes or has some kinds of structures, the propulsion machine so arranged as shown in FIG. 8 causes engine 7 obstructive or the propulsion machine cannot be arranged as such.

Figure 9:
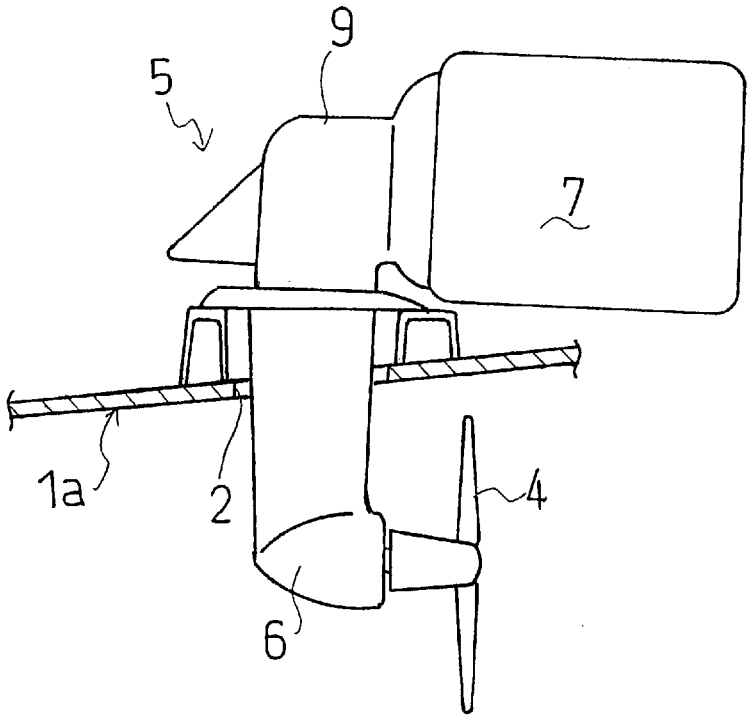
FIG. 9 is a side view of the same wherein the upper unit is disposed so as to arrange the engine behind the drive unit.

In such cases, upper unit 9 is rotated on joint surface 14 at an approximate 180° phase with respect to lower unit 6 so as to arrange engine 7 behind drive unit 5 as shown in FIG. 9.

While upper unit 9 rotated at the approximate 180° phase with respect to lower unit 6 is joined with lower unit 6, the communication between lower and upper oil-circulation passages 37 and 39 and that between oil-drain pipe 38 and upper oil-drain passage 44 are ensured without an additional oil passage or the like other than these passages.

Figure 10:
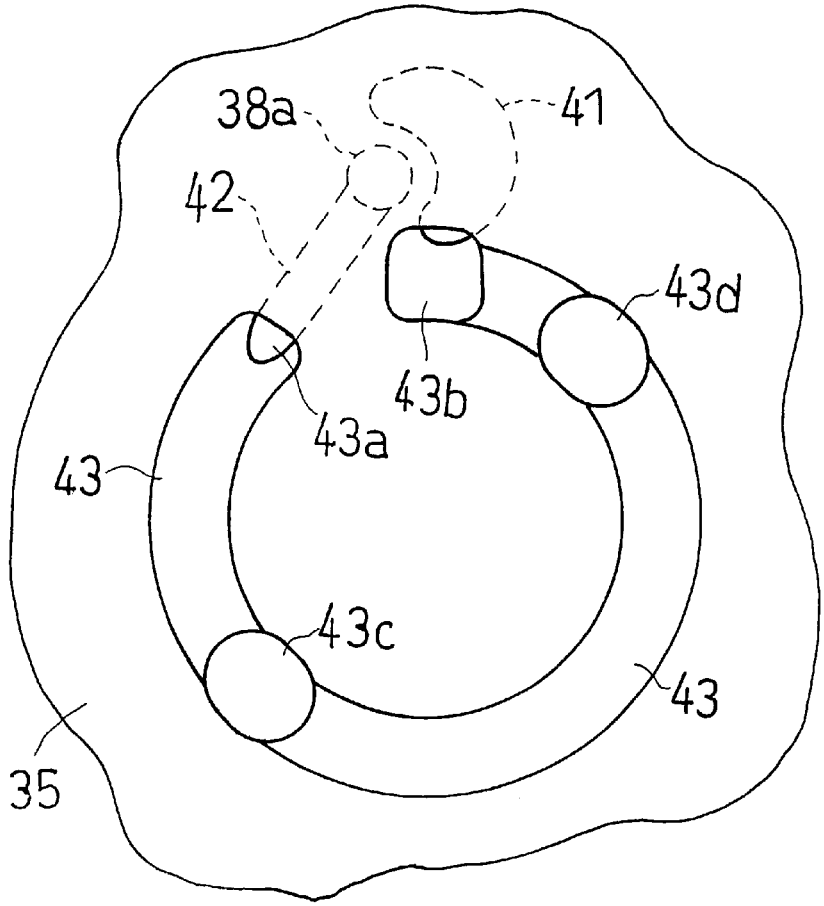
FIG. 10 is a plan view of a communication passage member.

In this regard, as shown in FIG. 10, communication passage 43 at the top surface of communication passage member 35 is shaped into an annular groove cut in a part. Communication passage 43 communicates with guide passage 42 for drained oil through its one end port 43*a*, and with guide passage 41 for circulated oil through its other end port 43*b*.

Figure 11:
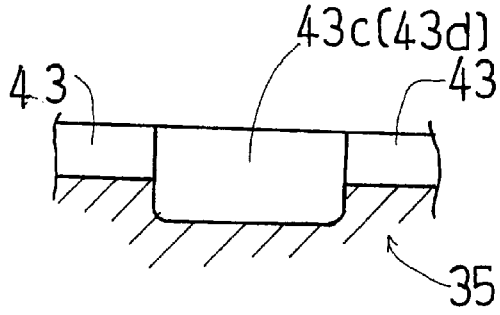
FIG. 11 is a sectional side view of a deep port of a communication passage.

Additionally, as shown in FIG. 11, communication passage 43 is provided its intermediate portions with deep ports 43*c* and 43*d* which are deeper than the other portions of communication passage 43. Deep ports 43*c* and 43*d* are arranged at an approximate 180° phase from each other.

Figure 12:
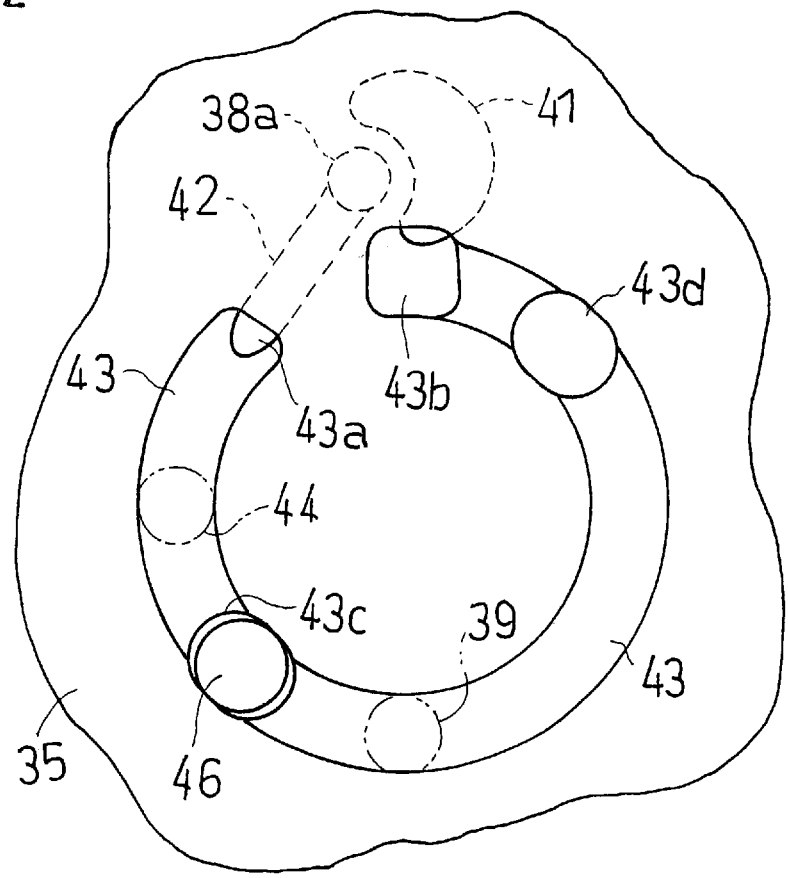
FIG. 12 is a plan view of the communication passage member when the upper unit is mounted so as to arrange the engine in front of the drive unit.

If upper unit 9 is set so as to arrange engine 7 in front of drive unit 5, as shown in FIG. 12, the lower end of upper oil-drain passage 44 is disposed into communication with communication passage 43 between end port 43*a* and deep port 43*c*, and the lower end of upper oil-circulation oil passage 39 is between end port 43*b* and deep port 43*c*.

Figure 13:
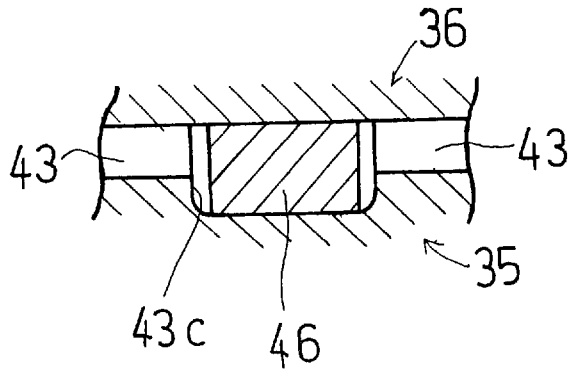
FIG. 13 is a sectional side view of the deep port into which a plug is inserted.

When upper unit 9 and lower unit 6 are joined with each other, as shown in FIG. 13, a plug 46 made of elastic material is inserted into deep port 43*c* so as to divide communication passage 43 into two parts.

In other words, one part of communication passage 43 in communication with upper oil-drain passage 44 is separated from the other part thereof in communication with upper oil-circulation passage 39 by insertion of plug 46 serving as a passage-shutter into deep port 43*c* serving as a mount portion for the passage-shutter.

Due to this design, the lubricating oil to be circulated in drive unit 5 can be circulated from lower oil-circulation passage 37 to upper oil-circulation passage 39 through guide passage 41 for circulated oil and communication passage 43. For draining the lubricating oil from drive unit 5, it can be drained out from oil-drain outlet 45 through oil-drain pipe 38, guide passage 42 for drained oil, communication passage 43 and upper oil-drain passage 44.

Figure 14:
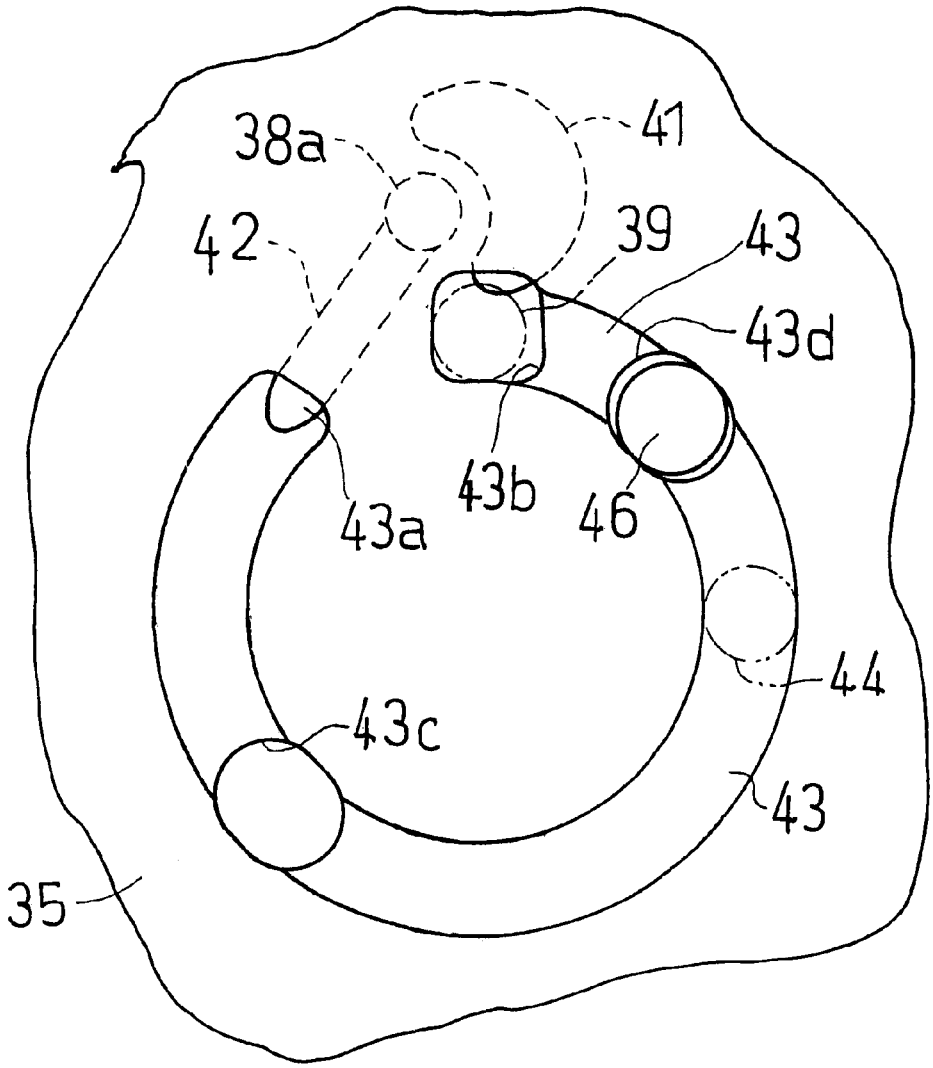
FIG. 14 is a plan view of the communication passage member when the upper unit is mounted so as to arrange the engine behind the drive unit.

On the other hand, in the case that upper unit 9 is rotated at the approximate 180° phase so as to arrange engine 7 behind drive unit 5, as shown in FIG. 14, the lower end of upper oil-drain passage 44 is disposed into communication with communication passage 43 between end port 43*a* and deep port 43*d*, and the lower end of upper oil-circulation passage 39 is between end port 43*b* and deep port 43*d*.

In this case, when upper unit 9 and lower unit 6 are joined with each other, plug 46 is inserted into deep port 43*d* so as to divide communication passage 43 into one part in communication with upper oil-drain passage 44 and the other part in communication with upper oil-circulation passage 39.

Due to this design, similarly with the above-mentioned, the lubricating oil to be circulated in drive unit 5 can be circulated from lower oil-circulation passage 37 to upper oil-circulation passage 39 through guide passage 41 for circulated oil and communication passage 43. For draining the lubricating oil from drive unit 5, it can be drained out from oil-drain outlet 45 through oil-drain pipe 38, guide passage 42 for drained oil, communication passage 43 and upper oil-drain passage 44.

Corresponding to either case wherein upper unit 9 is disposed so as to arrange engine 7 in front of drive unit 5 or behind drive unit 5, plug 46 is inserted into selective one of deep ports 43*c* and 43*d* of communication passage 43 so as to divide communication passage 43 into two parts, thereby ensuring the communication between lower and upper oil-circulation oil passages 37 and 39 and that between oil-drain pipe 38 and upper oil-drain passage 44 without a passage or the like other than these passages.

Accordingly, whether upper unit 9 is set so as to arrange engine 7 in front of drive unit 5 or upper unit 9 is rotated at the approximate 180° phase so as to arrange engine 7 behind drive unit 5, the lubricating oil can be circulated in drive unit 5 in similar manner, and can be drained from the very same oil-drain outlet 45.

Therefore, drive unit 5 is improved in its maintenance efficiency so that the lubricating oil can be exchanged on the sea regardless of the direction of set upper unit 6.

Description will now be given on a leak detecting mechanism arranged on a portion of drive unit 5 which is mounted onto mount base 3.

As mentioned above, first seal 15 is interposed between drive unit 5 and mount base 3 by use of annular seal flange 17 so as to close opening 2, thereby preventing the interior of hull 1 from leaking from opening 2 of bottom-of-hull 1*a*.

Figure 15:
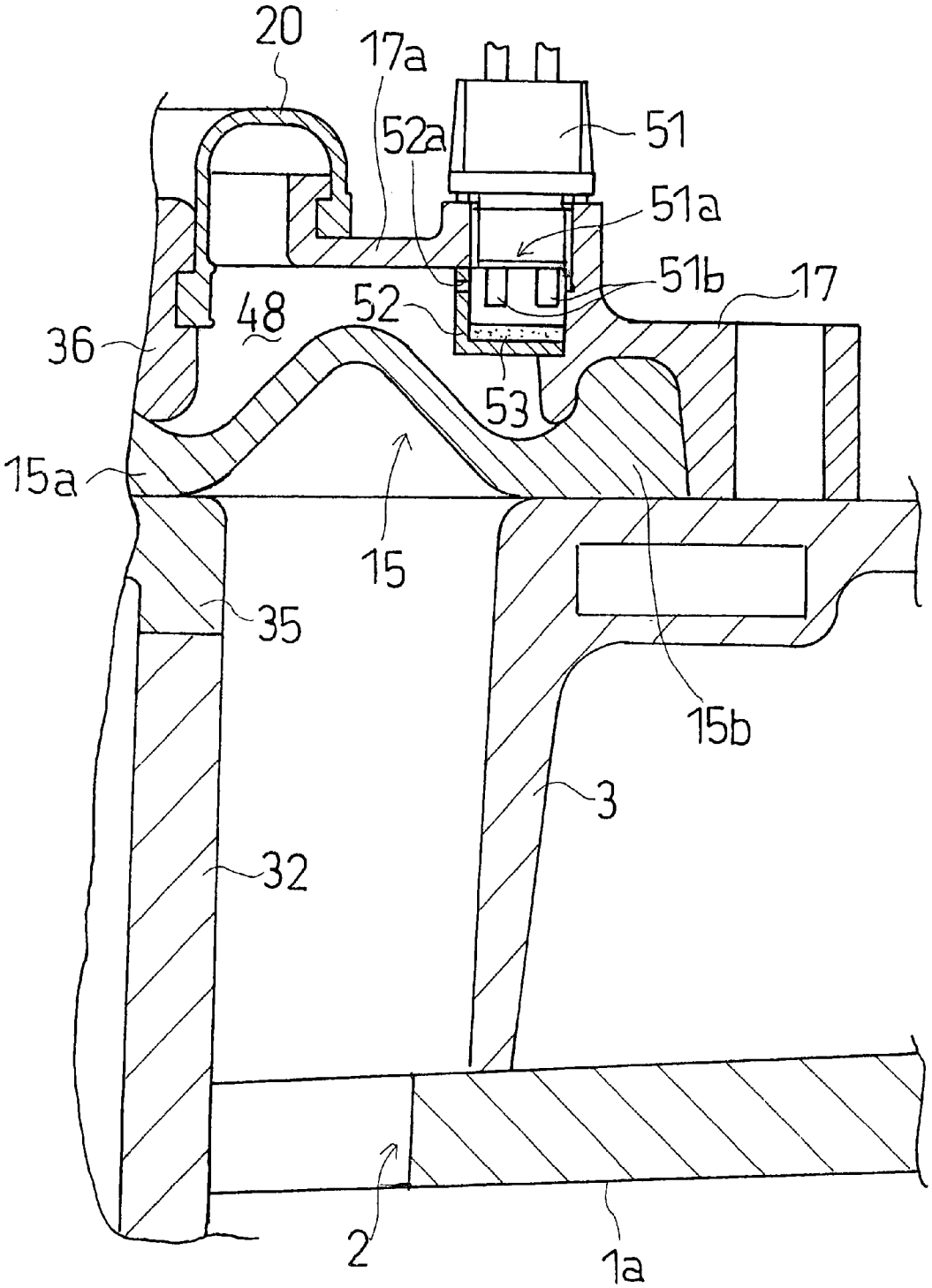
FIG. 15 is a sectional side view of a portion of the drive unit where a leak detecting mechanism is structured.

Furthermore, as shown in FIG. 15, annular seal flange 17 disposed above first seal 15 so as to be fixed together with inner peripheral thick portion 15*a* of first seal 15 onto mount base 3 is formed with a projection 17*a* projecting toward drive unit 5. Second seal 20 is interposed between projection 17*a* and upper casing 36 of drive unit 5, thereby separating a space 48 above first seal 15 from the interior of hull 1.

Thus, first seal 15 and second seal 20 are interposed between drive unit 5 and a portion for the mounting of drive unit where mount base 3, annular seal flange 17 and the like are disposed, thereby doubly sealing between inside and outside of hull 1. Even if first seal 15 is damaged, the leaking is checked in space 48 so that the interior of hull 1 is prevented from leaking.

A water sensor 51 is mounted onto projection 17*a* of annular seal flange 17. Water sensor 51 detects water flowed into space 48. A detecting portion 51*a* of water sensor 51 projects into space 48 above first seal 15 and is contained in a sensor casing 52. The interior of sensor casing 52 communicates with space 48 through a communication hole 52*a*.

Detecting portion 51*a* of water sensor 51 comprises a pair of electric conductors 51*b*, for example, which have a difference of electric potential therebetween. If both electric conductors 51*b* are brought into contact with liquid involving any electrolyte, electricity passes between both electric conductors 51*b*. Water sensor 51 detects the electric current.

Due to the above-mentioned leak detecting mechanism, if leaked water enters space 48 and sensor casing 52, electricity passes between both electric conductors 51*b* of water sensor 51, thereby detecting the leaking in space 48.

However, if the water flowed into sensor casing 52 is fresh water or the like involving little electrolyte, there is too little electricity passing between two electric conductors 51*b* of detecting portion 51 to detect the leaking.

Conventionally, such little electricity has been amplified by an amplifier for detecting the leaking in space 48. However, the amplifier is expensive, thereby increasing the cost of the leak detecting mechanism.

The present leak detecting mechanism in the present propulsion machine is provided with an electrolyte 53 stored in sensor casing 52 so that leaked fresh water can be detected without an amplifier.

If a boat equipped with the present propulsion machine, while being navigating or anchoring on a river, a lake or the like of fresh water, leaks so that fresh water flows into space 48, the fresh water further flows into sensor casing 52 through communication hole 52*a*. Then, electrolyte 53 stored in sensor casing 52 is dissolved into the fresh water so as to change the fresh water into electrolytic solution. Therefore, electricity passing between both electric conductors 51*b* of detecting portion 51*a* is generated enough to detect the leaking in space 48.

If seawater is leaked into space 48 while the boat equipped with the present propulsion machine navigates or anchors on the sea, sufficient electricity passes between both electric conductors 51*b* of detecting portion 51*a* so as to detect the seawater leaked in space 48 till electrolyte 53 is dissolved into the seawater.

Due to the storage of electrolyte 53 in sensor casing 52, the present leak detecting mechanism can surely detect leaked water even if the water is fresh water or the like involving little electrolyte, and can be constructed at low cost.

Possibility of Industrial Usage

The drive device of an inboard-and-outboard propulsion machine according to the present invention, which is connected to an engine in a hull and projects downward from a bottom of the hull into water, is suitable to a propulsion machine of a type applied to a boat like a yacht.

What is claimed is:

1. A drive device for an inboard-and-outboard propulsion machine, comprising:

a drive unit, for connection with an engine, mounted through an opening of a hull, and having a lower part for projecting from said hull opening into water, and having an upper part disposed within said hull;

a drive shaft substantially vertically disposed in said drive unit;

a follower gear disposed on an upper portion of said drive shaft; and, a drive gear unit, meshing with said follower gear, wherein said drive gear unit is slidably disposed in perpendicular to said upper portion of said drive shaft such that said drive gear unit is slidably shifted forwardly apart from said follower gear from outside said upper part of said drive unit within said hull, for removing said drive gear unit from said drive device without separating said drive gear unit from the engine.

2. A drive device for an inboard-and-outboard propulsion machine, applied to a drive unit mounted through an opening of a hull and brought into connection with an engine so that a lower unit serving as a lower part of said drive unit projects from said opening into water and a drive shaft is substantially vertically disposed in said drive unit, characterized in that an upper unit serving as an upper part of said drive unit disposed in said hull can be rotated for its mounting at an approximate 180° phase with respect to said lower unit, an oil-circulation passage for circulating lubricating oil in said drive unit and an oil-drain passage for draining lubricating oil outward from said drive unit communicate with each other, an oil-drain outlet of said oil-drain passage is provided at said upper unit disposed in said hull, a communication passage is disposed at a joint portion between said upper unit and said lower unit so that an upper oil-circulation passage and an upper oil-drain passage of said upper unit are respectively brought into communication with a lower oil-circulation passage and a lower oil-drain passage through said communication passage, said communication passage includes a pair of mounting portions apart from each other at an approximate 180° phase, and a passage shutter for dividing said communication passage into two parts is selectively mounted to one of said pair of mounting portions, thereby ensuring the communication between said upper and lower oil-circulation passages and the communication between said upper and lower oil-drain passages in whichever direction said upper unit is mounted.

* * * * *